US005243883A

United States Patent [19]

Savage

[11] Patent Number: 5,243,883

[45] Date of Patent: Sep. 14, 1993

[54] CLAMPING JAW PROJECTORS

[76] Inventor: Dave W. Savage, P.O. Box 218, St. Eugene, Ontario, Canada, K0B-1P0

[21] Appl. No.: 944,302

[22] Filed: Sep. 14, 1992

[51] Int. Cl.[5] ..... B25B 7/02

[52] U.S. Cl. ..... 81/421; 269/274; 269/276

[58] Field of Search ..... 81/421–424, 81/186, 185.1; 269/259, 261, 263, 271, 274–276, 279, 281, 283

[56] References Cited

U.S. PATENT DOCUMENTS 2,340,316 2/1944 Fest ..... 269/274

2,948,172 8/1960 Sloboda et al. ..... 269/274

*Primary Examiner*—D. S. Meislin

*Attorney, Agent, or Firm*—Leon Gilden

[57] ABSTRACT

A plurality of jaw protectors are provided, each having a cavity to receive an associated jaw of a clamping member such as a vise, vise-grip pliers, and the like. The clamp jaws resiliently engage a respective exterior surface of a respective jaw to provide for cushioning and protection of various articles supported between the jaw structure.

2 Claims, 4 Drawing Sheets

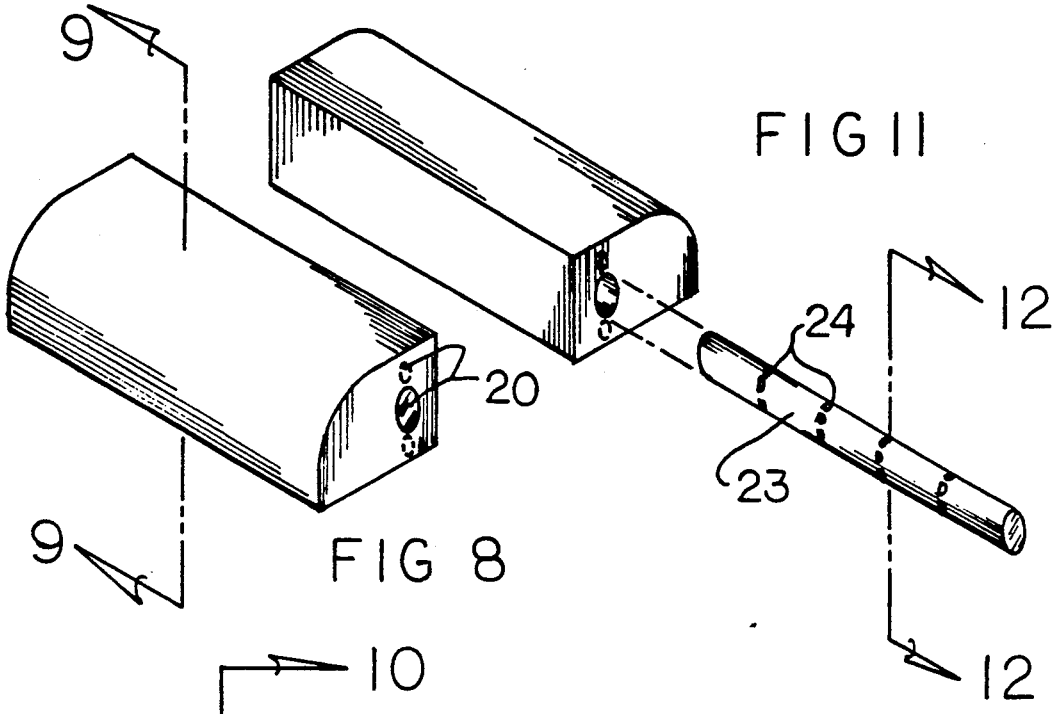
FIG 11
FIG 8
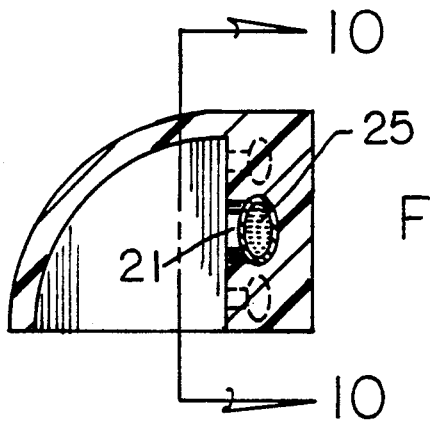
FIG 9
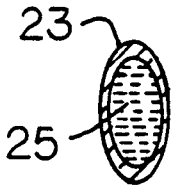
FIG 12
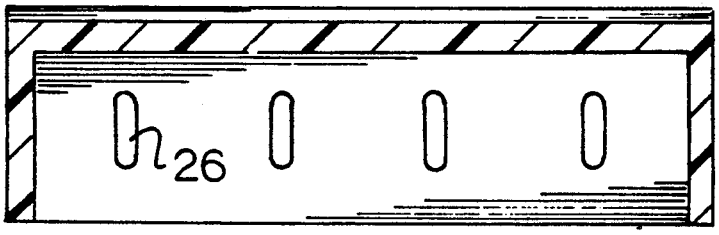
FIG 10

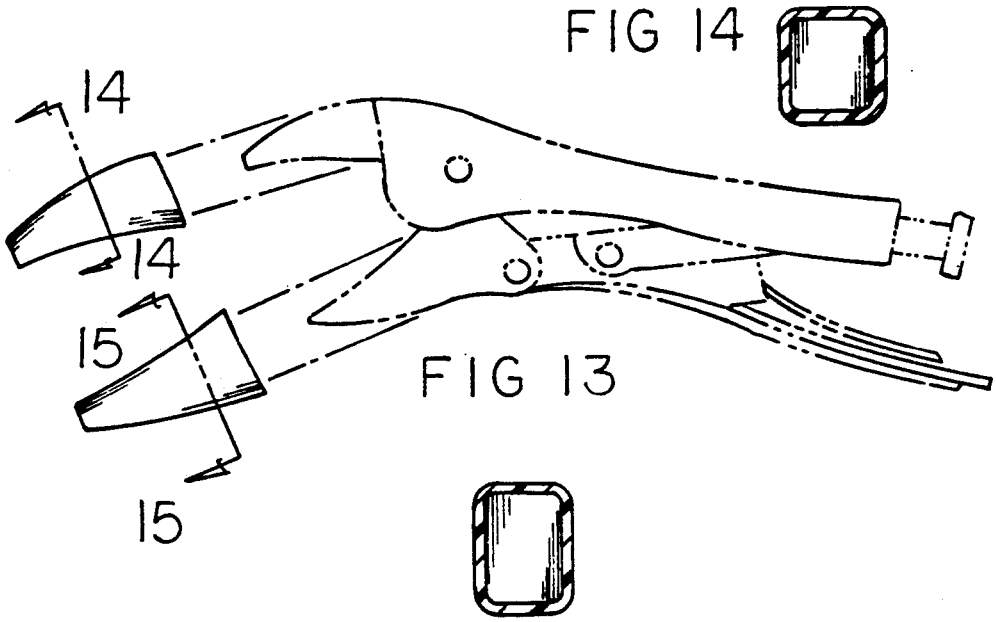
FIG 14
FIG 13
FIG 15
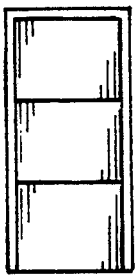
FIG 16
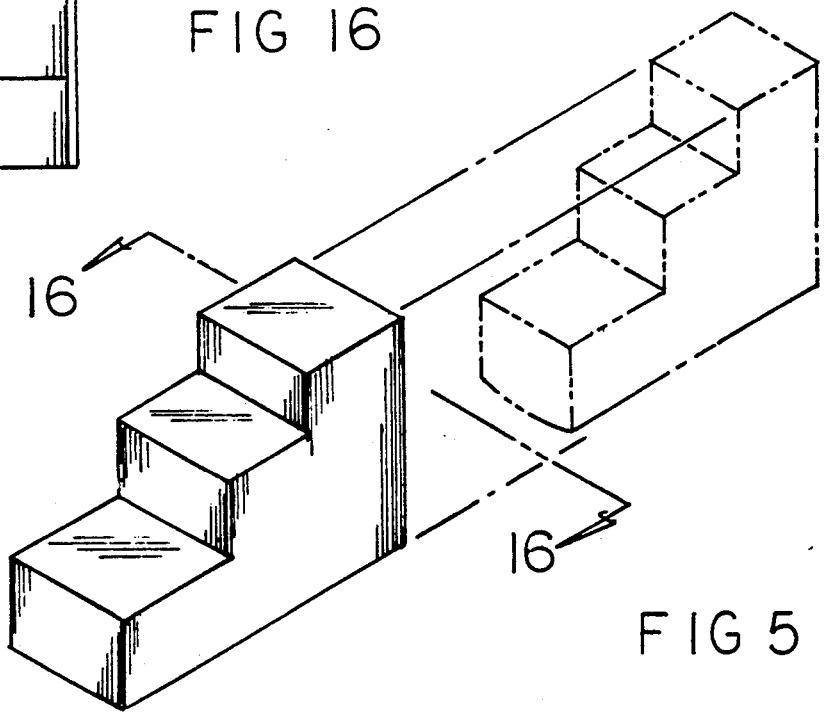
FIG 5

CLAMPING JAW PROJECTORS

BACKGROUND OF THE INVENTION

1. Field of the Invention

The field of invention relates to jaw protection devices, and more particularly pertains to new and improved clamping jaw protectors to afford protection to articles clamped between opposing clamping jaws.

2. Description of the Prior Art

Various jaw structure relative to clamping devices have been utilized in the prior art and exemplified by the U.S. Pat. Nos. 4,989,479; 4,813,310; 4,377,954; 4,944,204; and 3,694,834.

The clamp structure of the prior art, while recognizing jaw protector structure, has heretofore not available itself of the utilization of shape-retentent deformable protectors as set forth by the instant invention and in this respect, the present invention substantially fulfills this need.

SUMMARY OF THE INVENTION

In view of the foregoing disadvantages inherent in the known types of jaw protection structure now present in the prior art, the present invention provides clamping jaw protectors wherein the same utilize deformable memory retentent confronting jaw protectors to afford protection to articles mounted between an opposing clamp jaw structure. As such, the general purpose of the present invention, which will be described subsequently in greater detail, is to provide new and improved clamping jaw protectors which has all the advantages of the prior art jaw protector structure and none of the disadvantages.

To attain this, the present invention provides a plurality of jaw protectors, each having a cavity to receive an associated jaw of a clamping member such as vise, vise-grip pliers, and the like. The clamp jaws resiliently engage a respective exterior surface of a respective jaw to provide for cushioning and protection of various articles supported between the jaw structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved clamping jaw protectors which has all the advantages of the prior art jaw protection structure and none of the disadvantages.

It is another object of the present invention to provide new and improved clamping jaw protectors which may be easily and efficiently manufactured and marketed.

It is a further object of the present invention to provide new and improved clamping jaw protectors which is of a durable and reliable construction.

An even further object of the present invention is to provide new and improved clamping jaw protectors which is susceptible of a low cost of manufacture with regard to both materials and labor, and which accordingly is then susceptible of low prices of sale to the consuming public, thereby making such clamping jaw protectors economically available to the buying public.

Still yet another object of the present invention is to provide new and improved clamping jaw protectors which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5*a* is an isometric illustration of a step jaw structure for accommodating a step jaw, as indicated in phantom.

FIG. 8 is an isometric illustration of a further modified aspect of the invention.

FIG. 9 is an orthographic view, taken along the lines 9—9 of FIG. 8 in the direction indicated by the arrows.

FIG. 10 is an orthographic view, taken along the lines 10—10 of FIG. 9 in the direction indicated by the arrows.

FIG. 11 is an isometric illustration indicating the use of an adhesive cylinder mounted within one of the protector members.

FIG. 12 is an orthographic view, taken along the lines 12—12 of FIG. 11 in the direction indicated by the arrows.

FIG. 13 is an isometric illustration of the invention mounted to locking plier structure.

FIG. 14 is an orthographic view, taken along the lines 14—14 of FIG. 13 in the direction indicated by the arrows.

FIG. 15 is an orthographic view, taken along the lines 15—15 of FIG. 13 in the direction indicated by the arrows.

FIG. 16 is an orthographic view, taken along the lines 16—16 of FIG. 5 in the direction indicated by the arrows.

DESCRIPTION OF THE PREFERRED EMBODIMENT

Figure 2:
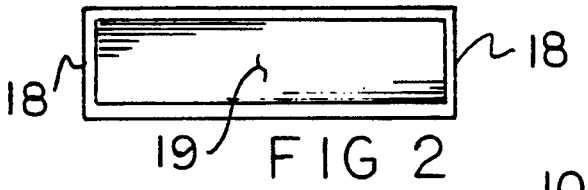
FIG. 2 is an orthographic view, taken along the lines 2—2 of FIG. 1 in the direction indicated by the arrows.
Figure 3:
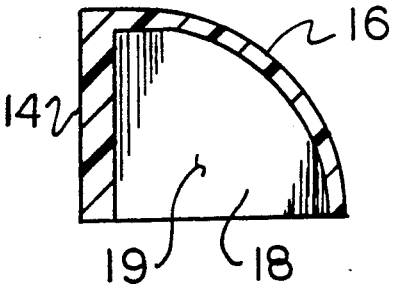
FIG. 3 is an orthographic view, taken along the lines 3—3 of FIG. 1 in the direction indicated by the arrows.
Figure 1:
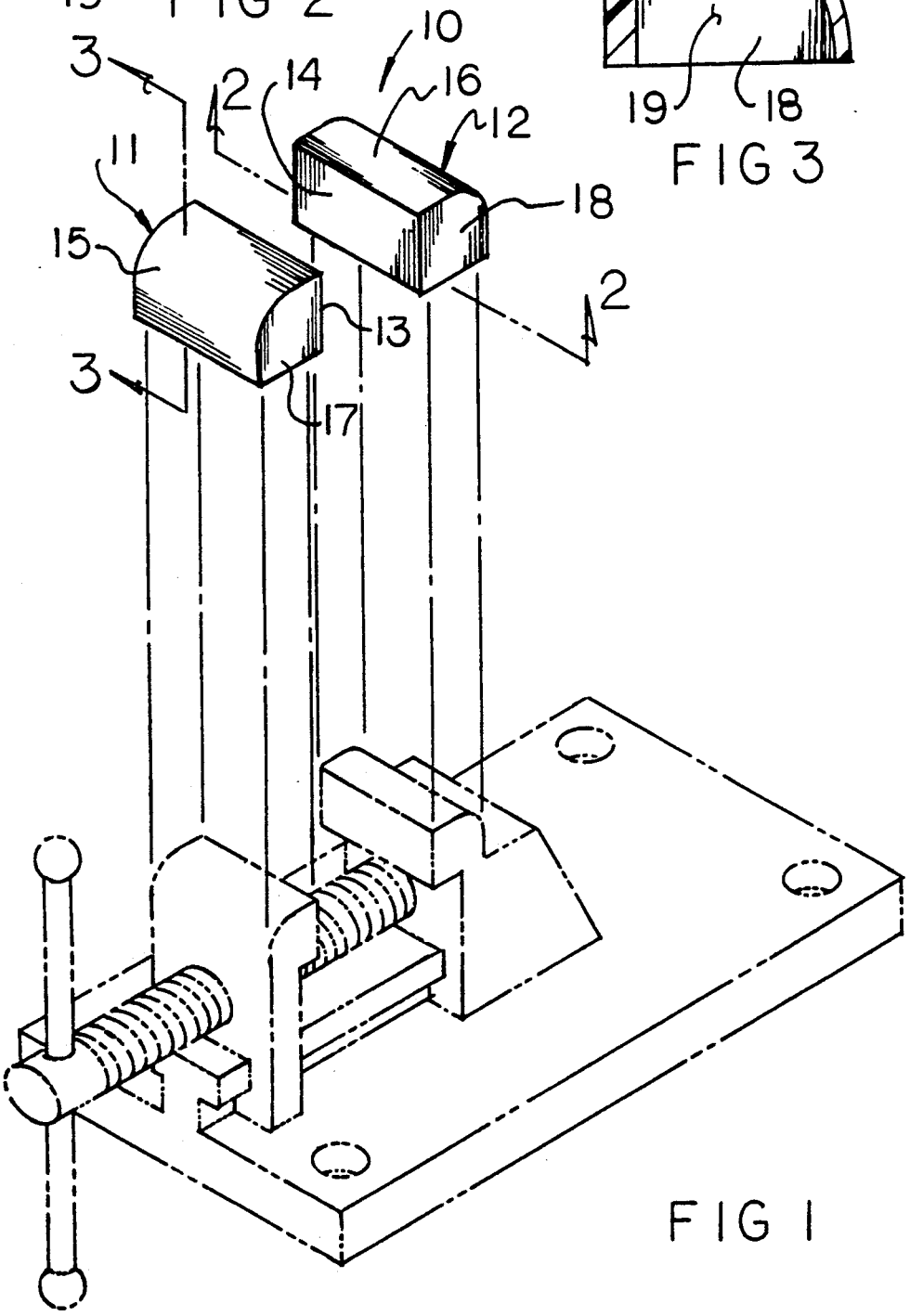
FIG. 1 is an isometric illustration of the invention in use.

With reference now to the drawings, and in particular to FIGS. 1 to 16 thereof, a new and improved clamping jaw protectors embodying the principles and concepts of the present invention and generally designated by the reference numeral 10 will be described.

More specifically, the clamping jaw protectors 10 of the instant invention essentially comprise first and second protector members 11 and 12 respectively formed of shape-retentive material to accommodate jaw members within a respective jaw receiving cavity 19 of each protector member 11 and 12. The first and second protector members 11 and 12 include first and second planar forward walls 13 and 14 respectively arranged in a confronting parallel relationship, with convex arcuate respective first and second rear walls 15 and 16 respectively directed and projecting rearwardly of the first and second forward walls 13 and 14. The first protector member 11 includes spaced parallel first side walls 17, with the second protector member 12 having second side walls 18 arranged in a parallel relationship.

Figure 4:
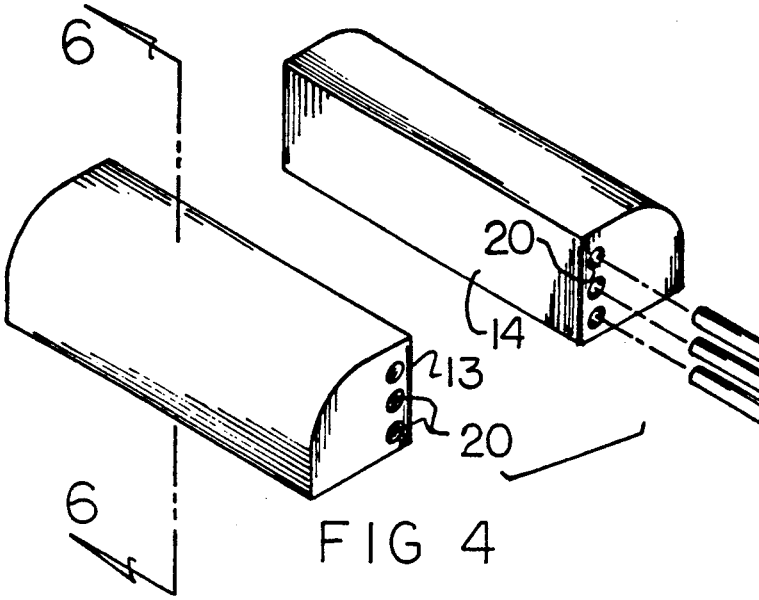
FIG. 4 is an isometric illustration of a modified aspect of the invention.

The organization as set forth in FIG. 4 further includes a plurality of cylindrical bores 20 that are arranged in a parallel relationship relative to one another and to the forward walls 13 and 14 respectively. Each set of cylindrical bores 20 include communication conduits 21 projecting from each cylindrical bore 20 into a respective jaw receiving cavity 19 of a respective protector member. In this manner, magnetic rods 22 are arranged for reception within the cylindrical bores 20 of each protector member for enhanced adherence in associated jaw structure of a tool member. If desired, at least one elongate adhesive flexible tube 23 having spaced perforations 24 are arranged for reception within one of the cylindrical bores 20. In this manner, application of pressure to a respective forward wall 13 and 14, adhesive fluid 25 contained within the flexible tube 23 is directed through a set of the communication conduits 21 as the communication conduits are spaced apart the predetermined spacing and positioned forwardly of the perforations. In this manner, permanent adherence of the protector members of an associated jaw structure is afforded and available to an individual if desired.

Figure 5:
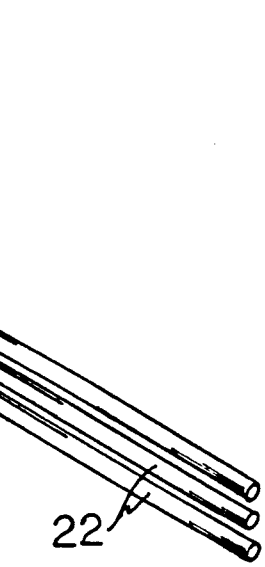
FIG. 5 is an isometric illustration of a further modified aspect of the invention.
Figure 6:
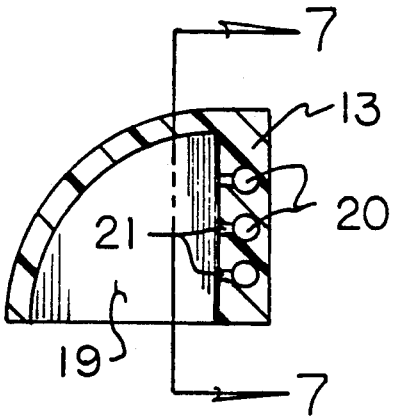
FIG. 6 is an orthographic view, taken along the lines 6—6 of FIG. 4 in the direction indicated by the arrows.
Figure 7:
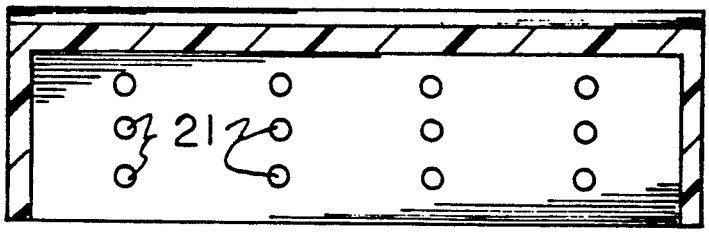
FIG. 7 is an orthographic view, taken along the lines 7—7 of FIG. 6 in the direction indicated by the arrows.

The FIG. 10 indicates the use of slots 26 in lieu of conduits. The step jaw structure, as set forth in the FIGS. 5 and 16, is arranged to accommodate step jaw portions of tool structure, and the FIGS. 13-15 indicate the use of the organization mounted upon portable locking pliers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Clamping jaw protectors arranged for mounting to clamping jaws of a tool assembly, wherein the clamping jaw protectors comprise, first and second protector members, each formed of a deformable shape-retentent material, with each of the first and second protector members including a first and second planar forward wall respectively, and a convex arcuate first rear wall extending from the first planar forward wall and an arcuate second rear wall extending from the second forward wall, and first side walls arranged in a parallel relationship extending along opposed sides of the first rear wall orthogonally intersecting the first forward wall, and second side walls arranged in a parallel relationship extending along the second rear wall orthogonally intersecting the second planar forward wall, and each of the first and second protector members having a jaw receiving cavity, and the first planar forward wall and the second planar forward wall are arranged in a parallel coextensive relationship relative to one another, and each of the first and second planar forward walls include a plurality of parallel cylindrical bores arranged parallel to one another, wherein the first planar forward wall includes said cylindrical bores parallel to the first forward wall, and the second forward wall includes further cylindrical bores of said cylindrical bores parallel to said second forward wall, and at least one magnetic rod directed within one of said cylindrical bores and one of said further cylindrical bores, and the cylindrical bores include at least one adhesive flexible tube, and said further cylindrical bores include at least a further flexible tube, wherein the flexible tube and the further flexible tube include adhesive fluid therewithin, and the flexible tube and the further flexible tube includes spaced perforations to permit rupture of the flexible tube and said further flexible tube, and each of the cylindrical bores and the further cylindrical bores include communication conduits to communicate the cylindrical bores and the further cylindrical bores within a respective jaw receiving cavity.

2. Clamping jaw protectors as set forth in claim 1 wherein said communication conduits are spaced apart a predetermined spacing, and said perforations are spaced apart said predetermined spacing.

* * * * *